United States Patent [19]

Valiulis

[11] Patent Number: 4,899,668

[45] Date of Patent: Feb. 13, 1990

[54] SHELF DIVIDER

[75] Inventor: Stanley C. Valiulis, Rockford, Ill.

[73] Assignee: Southern Imperial, Inc., Rockford, Ill.

[21] Appl. No.: 284,731

[22] Filed: Dec. 15, 1988

[51] Int. Cl.[4] ..... A47B 57/58

[52] U.S. Cl. ..... 108/61; 211/184; 40/642

[58] Field of Search ..... 108/60, 61; 211/184, 211/43, 106; 248/298; 40/642, 649, 653; 411/509, 510

[56] References Cited

U.S. PATENT DOCUMENTS

| | | | |
|---|---|---|---|
| 3,139,784 | 7/1964 | Moorman | 411/510 |
| 3,494,244 | 2/1970 | Wayland | 411/510 |
| 3,559,815 | 2/1971 | Huddleston | 211/184 |
| 4,190,167 | 2/1980 | Wells et al. | 211/184 |
| 4,351,440 | 9/1982 | Thalenfeld | 40/642 |
| 4,593,824 | 6/1986 | Pfeifer | 40/642 |
| 4,718,626 | 1/1988 | Thalenfeld et al. | 40/642 |

FOREIGN PATENT DOCUMENTS

| | | | |
|---|---|---|---|
| 0158337 | 10/1985 | European Pat. Off. | 40/642 |
| 2565388 | 12/1985 | France | 40/642 |

OTHER PUBLICATIONS pp. B15 and B16 of Trade Literature Published by Caliform, Inc., prior to Dec. 15, 1987.

*Primary Examiner*—Kenneth J. Dorner
*Assistant Examiner*—Brian K. Green
*Attorney, Agent, or Firm*—Leydig, Voit & Mayer

[57] ABSTRACT

A divider for separating adjacent zones of a retail merchandise shelf from one another in order to keep merchandise in each zone in a neat and orderly arrangement and to prevent mingling of merchandise in one zone with merchandise in an adjacent zone. The divider includes an elongated wire rod extending from the front of the shelf toward the rear thereof and having a disc on its rear end portion for holding the rear end portion of the rod in upwardly spaced relation with the shelf. A bracket is attached releasably and slidably to a laterally projecting finger on the front end of the rod and keeps the front of the rod spaced upwardly from the shelf while permitting adjustment of the rod along the shelf. In addition, the bracket is formed with two laterally space holes which receive push pins adapted to telescope into holes in the shelf in order to secure the divider in a fixed position on the shelf. The pins are spaced 1" apart and enable the divider to be used with a shelf having holes spaced either on ½" increments or 1" increments. The bracket also may be designed to hold a label having printed information relating to the merchandise in the zone.

18 Claims, 2 Drawing Sheets

SHELF DIVIDER

BACKGROUND OF THE INVENTION

This invention relates to a divider for use on a retail shelf to separate the shelf into zones and help keep the merchandise in each zone in a neat and orderly arrangement.

SUMMARY OF THE INVENTION

The general aim of the present invention is to provide a new and relatively simple and inexpensive zone divider which may be quickly and easily attached to and removed from a shelf and which is adapted to be securely held on the shelf in any selected one of closely adjacent lateral positions.

In a more detailed sense, the invention resides in the provision of a zone divider in the form of an elongated rod having means on its rear end portion for spacing the rear end portion of the rod above the shelf. A mounting bracket on the front end portion of the rod spaces the front end portion above the shelf and slidably receives the rod so as to enable the rod to be adjusted along the length of the shelf. The mounting bracket is adapted to receive pins which are spaced apart by 1" and which may be inserted releasably into holes in the shelf in order to secure the divider in place. The holes are spaced from one another along the front of the shelf at either ½" increments or 1" increments and, by sliding the rod relative to the bracket, the divider can be located at virtually any position along the shelf.

Another object of the invention is to provide a zone divider in which the front mounting bracket also serves as a holder for a price and inventory label or the like.

These and other objects and advantages of the invention will become more apparent from the following detailed description when taken in conjunction with the accompanying drawings.

DETAILED DESCRIPTION OF THE PREFERRED EMBODIMENTS

The present invention contemplates the provision of a divider 10 which may be used to separate a merchandise display shelf 11 into separate zones. Several dividers may be used on one shelf and serve to keep the merchandise in the zones neat and orderly while preventing mingling of merchandise in adjacent zones.

Herein, the shelf 11 is made of plastic or metal and is formed with one or more laterally extending rows of laterally spaced holes 12. The holes may be in a single row along the front of the shelf or, in some cases, the entire shelf may be perforated. Typically, the holes are spaced laterally from one another either by ½" increments or by 1" increments. The holes which have been shown are spaced apart by ½".

The divider 10 includes an elongated and fore-and-aft extending rod 13 preferably made of round wire having a diameter of 0.149" or 0.186". The length of the rod may vary according to the width of the shelf 11 but the rod should be sufficiently long to extend near the rear of the shelf when the front end of the rod is located near the front of the shelf.

Figure 2:
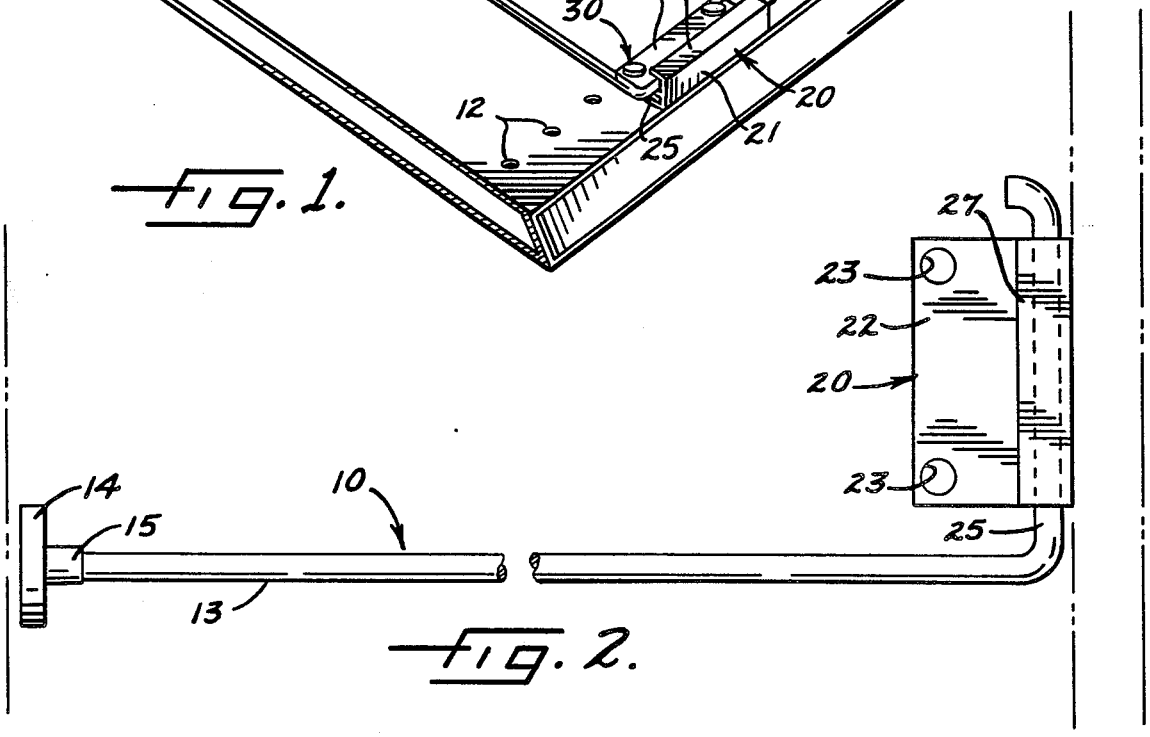
FIG. 2 is an enlarged top plan view of one of the dividers shown in FIG. 1.

Means are provided for spacing the rear end portion of the rod 13 upwardly from the shelf 11 by a predetermined distance (e.g., ½"). Herein, these means comprise a circular disc 14 preferably made of plastic and disposed in a laterally extending plane. Molded integrally with and projecting forwardly from the forward face of the disc is a cylindrical sleeve 15 (FIG. 2) which is telescoped snugly over the rear end portion of the rod. The sleeve may be secured to the rod either by a grip fit, by cement or by both.

Figure 3:
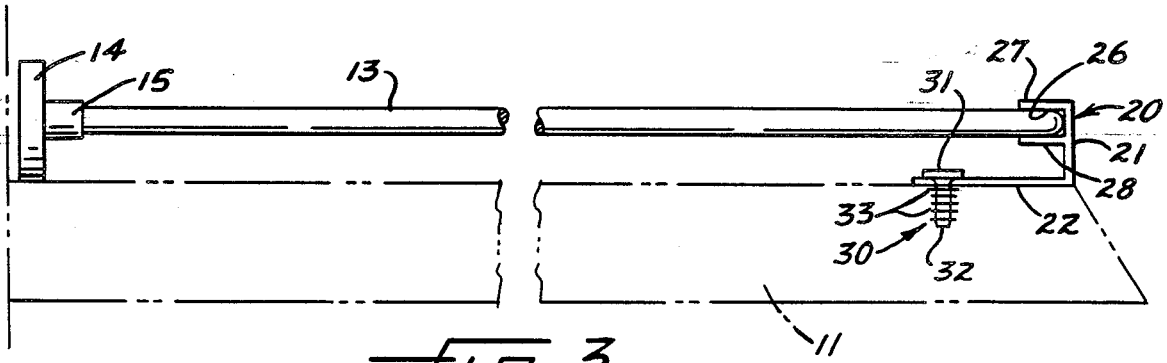
FIG. 3 is a side elevational view of the divider shown in FIG. 2.

Pursuant to the invention, provision is made of a novel bracket 20 for securing the rod 13 to the shelf 11 in vertically spaced relation therefrom. The bracket is made of plastic and includes a vertical front plate 21 (FIG. 3). A horizontal tongue 22 is formed integrally with and projects rearwardly from the lower margin of the plate. Formed vertically through the rear edge portion of the plate are two holes 23 (FIG. 2) which are spaced laterally from one another by a distance of 1".

In order to secure the rod 13 to the bracket 20, a laterally projecting finger 25 (FIG. 2) is formed integrally with and projects laterally from the front end of the rod. The finger is adapted to fit snugly but releasably in a rearwardly opening channel 26 (FIG. 3) located at the rear face of the plate 21. The channel is defined by an upper strip 27 extending rearwardly from the upper margin of the plate and by a lower strip 28 extending rearwardly from the rear face of the plate about midway between the upper and lower ends thereof. The vertical spacing between the strips 27 and 28 is such that the strips may resiliently grip the finger 25 to hold the rod and the bracket in assembled relation while allowing the finger to slide longitudinally in the channel. The finger has an effective length which is approximately 1" greater than the length of the channel.

The rod 13 may be assembled with the bracket 20 merely by snapping the finger 25 into the channel 26. Thereafter, the divider 10 may be installed on the shelf 11 simply by placing pins 30 through the holes 23 in the tongue 22 and into underlying holes 12 in the shelf. While various types of pins may be used, the preferred pin is a plastic push-in pin having a head 31, a shank 32 and several radially extending and annular fins 33 spaced axially along the shank. The fins flex as the shank is telescoped into the holes 23 and 12 and then expand into engagement with the walls of the holes in order to hold the shank in snug but releasable telescoped relation with the holes.

Figure 1:
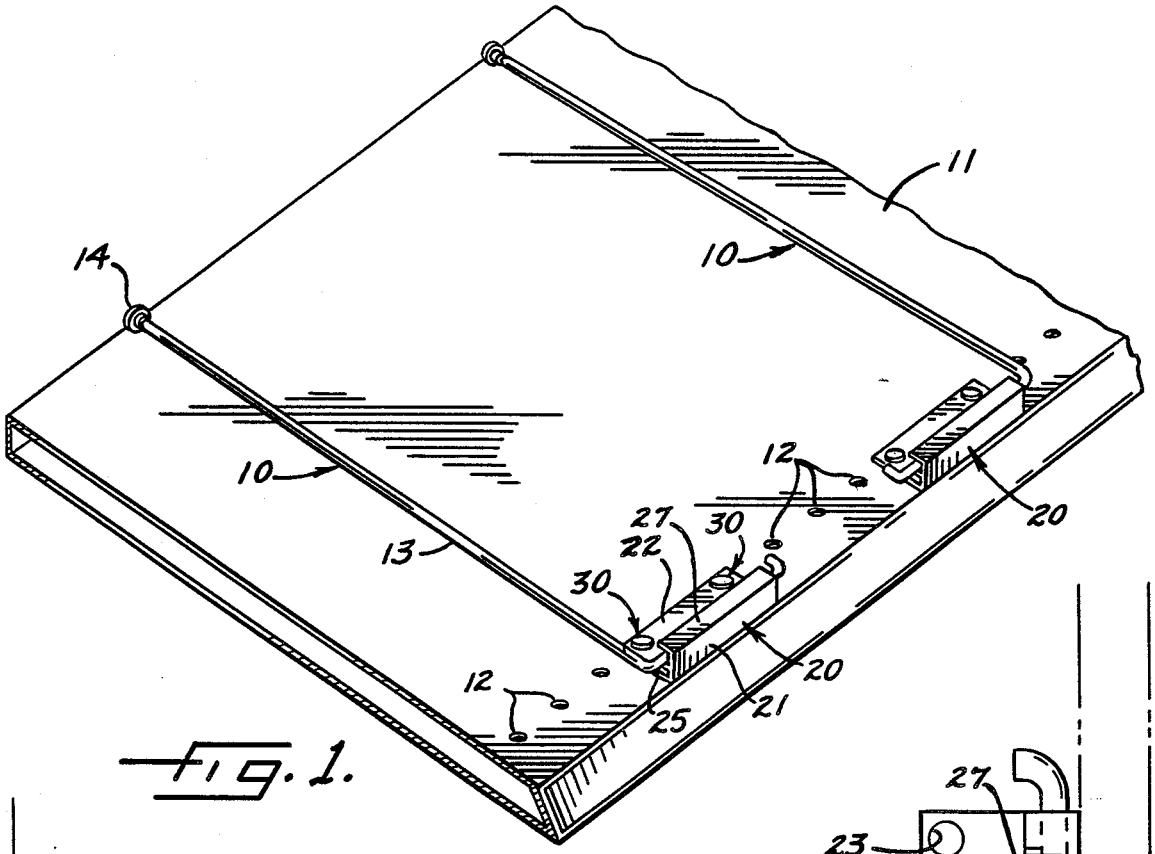
FIG. 1 is a fragmentary perspective view of a typical shelf equipped with one embodiment of new and improved zone dividers incorporating the unique features of the present invention.

The foregoing arrangement provides a very simple and inexpensive divider 10 which may be quickly attached to the shelf 11 at ½" increments along the shelf. By sliding the finger 25 longitudinally within the channel 26, a virtually infinite adjustment can be achieved. Moreover, the same divider 10 may be used either as a left-hand divider or a right-hand divider simply by turning the divider about the axis of the rod 13. FIG. 1 shows one divider being used as a left-hand divider and the other divider being used as a right-hand divider.

Figure 4:
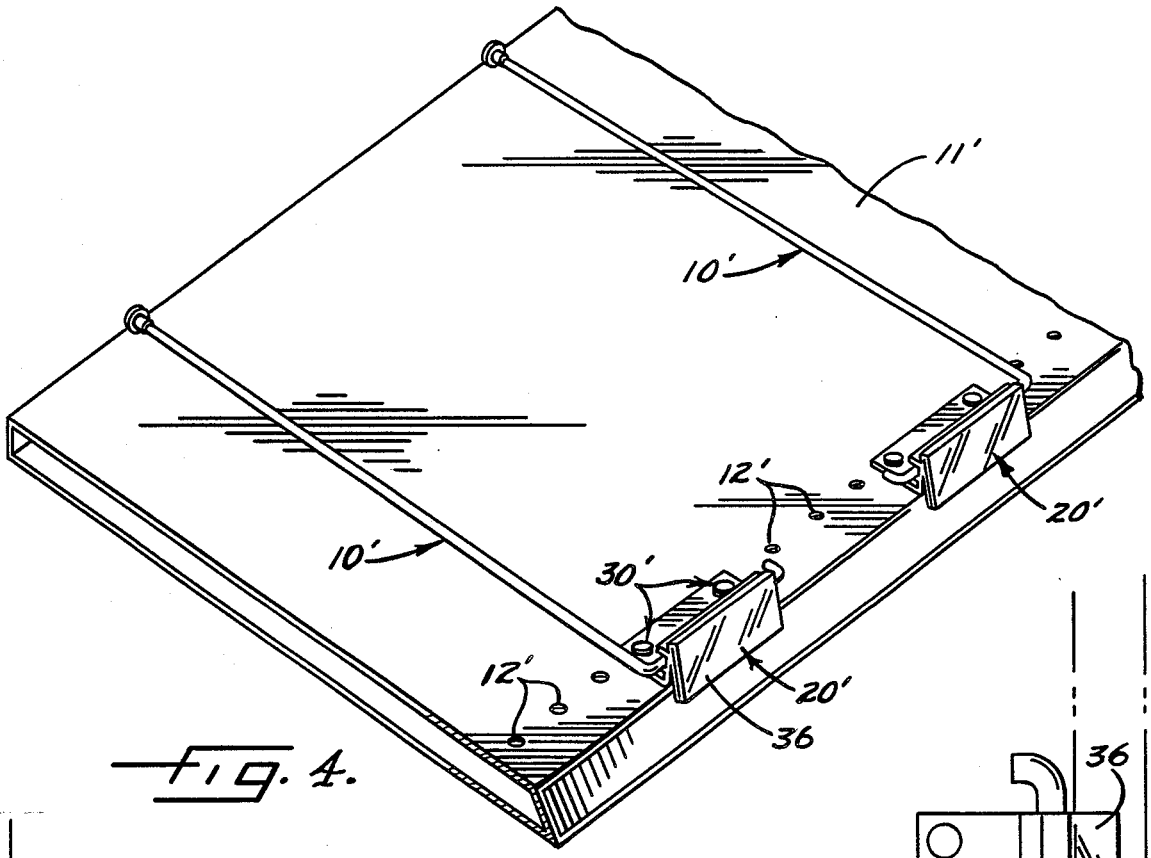
FIG. 4 is a view similar to FIG. 1 but shows dividers having modified attaching brackets.
Figure 5:
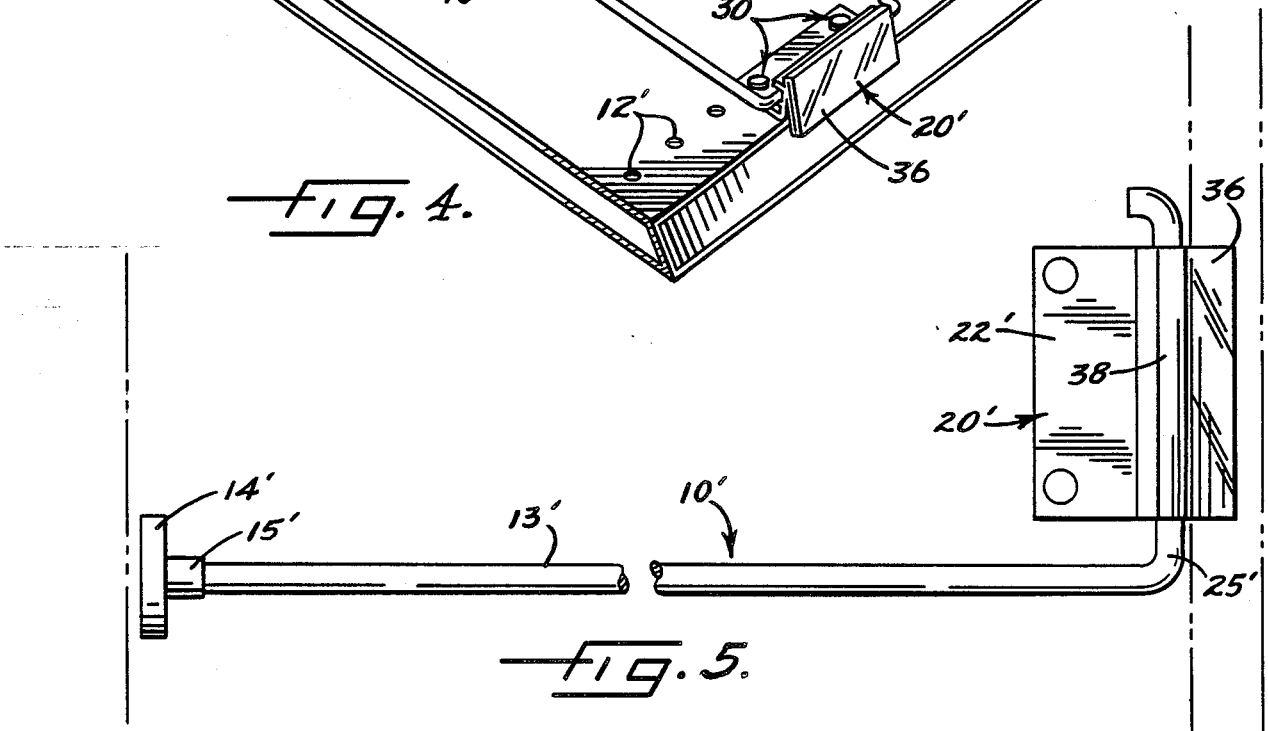
FIG. 5 is an enlarged top plan view of one of the dividers in shown in FIG. 4.
Figure 6:
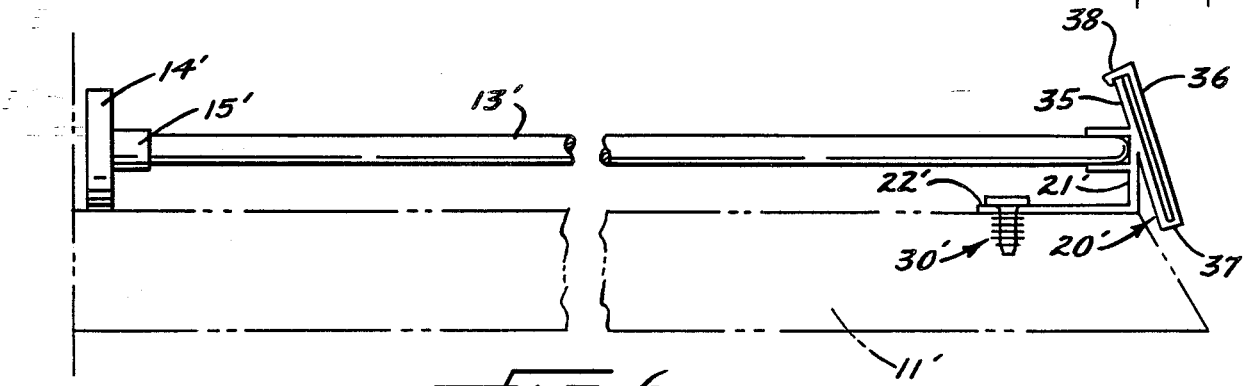
FIG. 6 is a side elevational view of the divider shown in FIG. 5.

A divider 10' with a modified bracket 20' is shown in FIGS. 4 to 6 in which parts corresponding to those of the first embodiment are indicated by the same but primed reference numerals. The bracket 20' is particularly characterized in that it is capable of holding a tag or label containing pricing information, a stock number, a description or the like adapted to be scanned by an electronic wand.

More specifically, the bracket 20' includes a second plate 35 molded integrally with the upper margin of the front side of the plate 21' and inclined so as to extend rearwardly upon progressing upwardly. A flap 6 is molded integrally with a short forwardly projecting extension 37 at the lower margin of the plate 21'. The flap 36 extends parallel to the plate 5 and may be hinged downwardly and outwardly about the extension 37 to enable the label to be placed between the flap and the plate. A fin 38 preferably extends rearwardly from the upper margin of the flap 36 and covers the space between the upper ends of the flap and the plate 35. In addition, the fin is hooked behind the upper edge portion of the plate 35 so as to releasably hold the flap in a closed position.

I claim:

1. A divider for a generally horizontal shelf, said shelf having front and rear ends and having a laterally extending row of laterally spaced and upright holes located adjacent the front end of the shelf, said divider comprising an elongated horizontal rod extending from the front end of the shelf toward the rear end thereof, said rod having front and rear ends, an elongated horizontal finger formed integrally with and projecting laterally from the front end of said rod, a bracket attached to said finger and engagaeable with said shelf to space the front end of said rod a predetermined distance above said shelf, and a pair of laterally spaced pins projecting downwardly from said bracket and sized to fit snugly but releasably in two of said holes thereby to hold said divider in a substantially fixed position on said shelf.

2. A divider as defined in claim 1 further including spacer means on the rear end of said rod and engageable with said shelf to space said rear end above said shelf by approximately said predetermined distance.

3. A divider as defined in claim 2 in which said spacer means comprise a disc secured to the rear end of said rod and disposed in an upright plane extending laterally of the rod.

4. A divider as defined in claim 3 in which said disc is molded of plastic and includes a forward face, and a sleeve formed integrally with and projecting forwardly from the forward face of said disc and telescoped snugly over the rear end of said rod.

5. A divider as defined in claim 1 in which said bracket includes a rear side having a channel which receives said finger to attach said bracket to said finger.

6. A divider as defined in claim 5 in which said finger is longitudinally slidable in said channel.

7. A divider as defined in claim 1 in which said bracket includes a front side having means for holding a label.

8. A divider as defined in claim 1 in which said pins are sized to telescope slidably into said holes with a snug fit.

9. A divider as defined in claim 8 in which each of said pins includes an elongated shank molded of resiliently yieldable plastic, and a series of radially extending annular fins molded integrally with and spaced axially along the shank of each fastener.

10. A divider for a generally horizontal shelf, said shelf having front and rear ends and having a laterally extending row of laterally spaced and upright holes located adjacent the front end of the shelf, said divider comprising an elongated horizontal rod extending from the front end of the shelf toward the rear end thereof, said rod having front and rear ends, a radially extending disc located in a laterally extending plane on the rear end of said rod and engageable with said shelf to space the rear end of said rod a predetermined distance above said shelf, an elongated horizontal finger formed integrally with and projecting laterally from the front end of said rod, a laterally extending bracket having front and rear sides, means on the rear side of said bracket for attaching said bracket releasably to said finger, said bracket being engageable with said shelf to space the front end of said rod above said shelf by approximately said predetermined distance, and a pair of laterally spaced push pins projecting downwardly from said bracket and sized to telescope snugly but releasably into two of said holes thereby to hold said divider in a substantially fixed position on said shelf.

11. A divider as defined in claim 10 in which said disc is molded of plastic and includes a forward face, and a sleeve formed integrally with and projecting forwardly from the forward face of said disc and telescoped snugly over the rear end of said rod.

12. A divider as defined in claim 10 in which the rear side of said bracket includes a channel which receives said finger to attach said bracket to said finger.

13. A divider as defined in claim 12 in which said finger is longitudinally slidable in said channel.

14. A divider as defined in claim 13 in which the length of said finger is substantially greater than the length of said channel

15. A divider as defined in claim 10 in which said bracket comprises an upright plate located in front of said finger, a tongue extending rearwardly from said plate and disposed in a horizontal plane, and a pair of laterally spaced and vertically extending holes formed through said tongue for receiving said pins.

16. A divider as defined in claim 10 in which said bracket is molded of plastic and comprises a plate disposed in a plane which slopes rearwardly upon progressing upwardly, a flap molded integrally with the lower end portion of said plate, said flap being spaced forwardly from and normally extending parallel to said plate, said flap being adapted to swing downwardly and forwardly relative to said plate to enable a label to be placed between said flap and said plate.

17. A divider for a generally horizontal shelf, said shelf having front and rear ends and having a laterally extending row of laterally spaced and upright holes located adjacent the front end of the shelf, said divider comprising an elongated horizontal rod extending from the front end of said shelf toward the rear end thereof, said rod having front and rear ends, an elongated horizontal finger formed integrally with and projecting laterally from the front end of said rod, a laterally extending bracket having front and rear sides, a laterally extending channel on the rear side of said bracket and receiving said finger to attach said finger and said rod releasably to said bracket, said finger being slidable within said channel to permit said rod to be adjusted laterally of said bracket, said bracket engaging said shelf to space the front end of said rod a predetermined distance above said shelf, and a pair of laterally spaced pins depending from said bracket and sized to telescope snugly but releasably into two of said holes thereby to hold said divider in a substantially fixed position on said shelf.

18. A divider as defined in claim 17 in which said channel opens rearwardly to enable said rod and finger to be attached to said bracket by pushing said finger forwardly into said channel.

* * * * *